US006681770B1

(12) United States Patent
Dreher

(10) Patent No.: US 6,681,770 B1
(45) Date of Patent: Jan. 27, 2004

(54) SPINAL TREATMENT TABLE WITH LENGTH ADJUSTABLE CONTOURED SPINAL SUPPORT

(76) Inventor: Albert Shane Dreher, 3826 Madeira Way, Livermore, CA (US) 94550

( * ) Notice: Subject to any disclaimer, the term of this patent is extended or adjusted under 35 U.S.C. 154(b) by 157 days.

(21) Appl. No.: 09/981,384

(22) Filed: Oct. 17, 2001

(51) Int. Cl.[7] ..... A61H 1/00; A61H 7/00

(52) U.S. Cl. ..... 128/845; 606/239; 606/240; 606/242; 601/55; 601/100; 601/99; 601/103; 601/111; 601/148; 5/613

(58) Field of Search ..... 601/18, 19, 23, 601/24, 49–55, 97, 98, 99, 101, 102, 103, 86, 87, 90, 93, 94, 115–117, 100, 148; 602/32, 33; 606/240–245, 239; 5/613, 600, 933, 934; 128/845

(56) References Cited

U.S. PATENT DOCUMENTS 2,693,796 A * 11/1954 Warner ..... 601/98
5,054,142 A * 10/1991 Owens ..... 5/633
5,088,475 A 2/1992 Steffensmeier
5,103,808 A * 4/1992 Iams et al. ..... 601/101
5,320,640 A 6/1994 Riddle et al.
5,505,691 A * 4/1996 Fenkell ..... 606/241
5,514,078 A 5/1996 Palmer
5,637,076 A 6/1997 Hazard et al.
5,667,529 A 9/1997 Butner
5,860,899 A * 1/1999 Rassman ..... 601/90
6,077,293 A 6/2000 King
6,319,213 B1 * 11/2001 Tomac ..... 601/90

* cited by examiner

*Primary Examiner*—Nicholas D. Lucchesi
*Assistant Examiner*—Quang D. Thanh
(74) *Attorney, Agent, or Firm*—Jack Lo

(57) ABSTRACT

A spinal treatment table includes a head support, a leg support, and a contoured spinal support there between defined by separate support segments of different heights. The segments are supported within a frame and connected by a scissors hinge. A first end segment is anchored to the frame, and the other segments are movable longitudinally within the frame. A linear drive is connected to a second end segment. All the segments are moved by the same amount relative to adjacent segments whenever the second end segment is moved by the linear drive to adjust the length of the spinal support for supporting spines of different lengths. A spinal manipulation device is movable within a longitudinal slot in the spinal support for evenly applying therapy to the length of the spine. The spinal manipulation device may be a reciprocating device, a roller device, or a water jet device.

24 Claims, 9 Drawing Sheets

SPINAL TREATMENT TABLE WITH LENGTH ADJUSTABLE CONTOURED SPINAL SUPPORT

BACKGROUND OF THE INVENTION

1. Field of the Invention

This invention relates generally to chiropractic and massage tables.

2. Prior Art

Chiropractic therapy is a system of treating aliments by manipulating various body structures, but primarily the spine. The manipulation may be done by hand or by motorized manipulation devices. Typical machines knead the body with rollers, shake the body with vibrators, or push the body with reciprocating adjustment devices. Some machines are hand-held, and some are built into tables.

A typical hand-held machine called an adjuster is sold under the trademark "ARTHROSTIM" by IMPAC Inc. of Salem, Oreg. It is comprised of a stylus or tip attached to a motor for delivering linear thrusts in rapid petition to the treatment area. The travel distance of the tip is adjustable by turning a knob. Interchangeable tips are provided, including a forked tip. Another type of hand-held machine called a percussion instrument is sold under the trademark "VIBRACUSSOR" by IMPAC Inc. It is comprised of a broad head attached to a motor for applying vibrations to the treatment area. Although economical to purchase, hand-held devices are tedious to use. They are also expensive to operate because they require the doctor or therapist to spend a great deal of time to personally operate them. Further, it is difficult for the practitioner to hold the device at the proper angle to the treatment area for optimal effect.

Some table-mounted adjustment devices are driven to move along the table for applying therapy to different parts of the body. An example shown in U.S. Pat. No. 5,088,475 to Steffensmeier. However, prior art tables are flat and cannot properly support the curved spine of a patient who is lying supine or face up. Also, table-mounted spinal manipulation devices cannot properly follow the curvature of the spine to apply the treatment with equal force to different parts of the spine.

OBJECTIVES OF THE INVENTION

The objectives of the present spinal treatment table are: to evenly support the curvature of the spine of a patient who is lying supine; to be adjustable for evenly supporting the spine within a wide range of spinal lengths; and to automatically and evenly apply therapeutic treatment along the length of the spine.

Further objectives of the present invention will become apparent from a consideration of the drawings and ensuing description.

BRIEF SUMMARY OF THE INVENTION

A spinal treatment table includes a head support, a leg support, and a contoured spinal support there between defined by separate support segments of different heights. The segments are supported within a frame and connected by a scissors hinge. A first end segment is anchored to the frame, and the other segments are movable longitudinally within the frame. A linear drive is connected to a second end segment. All the segments are moved by the same amount relative to adjacent segments whenever the second end segment is moved by the linear drive to adjust the length of the spinal support for supporting spines of different lengths. A spinal manipulation device is movable within a longitudinal slot in the spinal support for evenly applying therapy to the length of the spine. The spinal manipulation device may be a reciprocating device, a roller device, or a water jet device.

DRAWING REFERENCE NUMERALS

Figure 1:
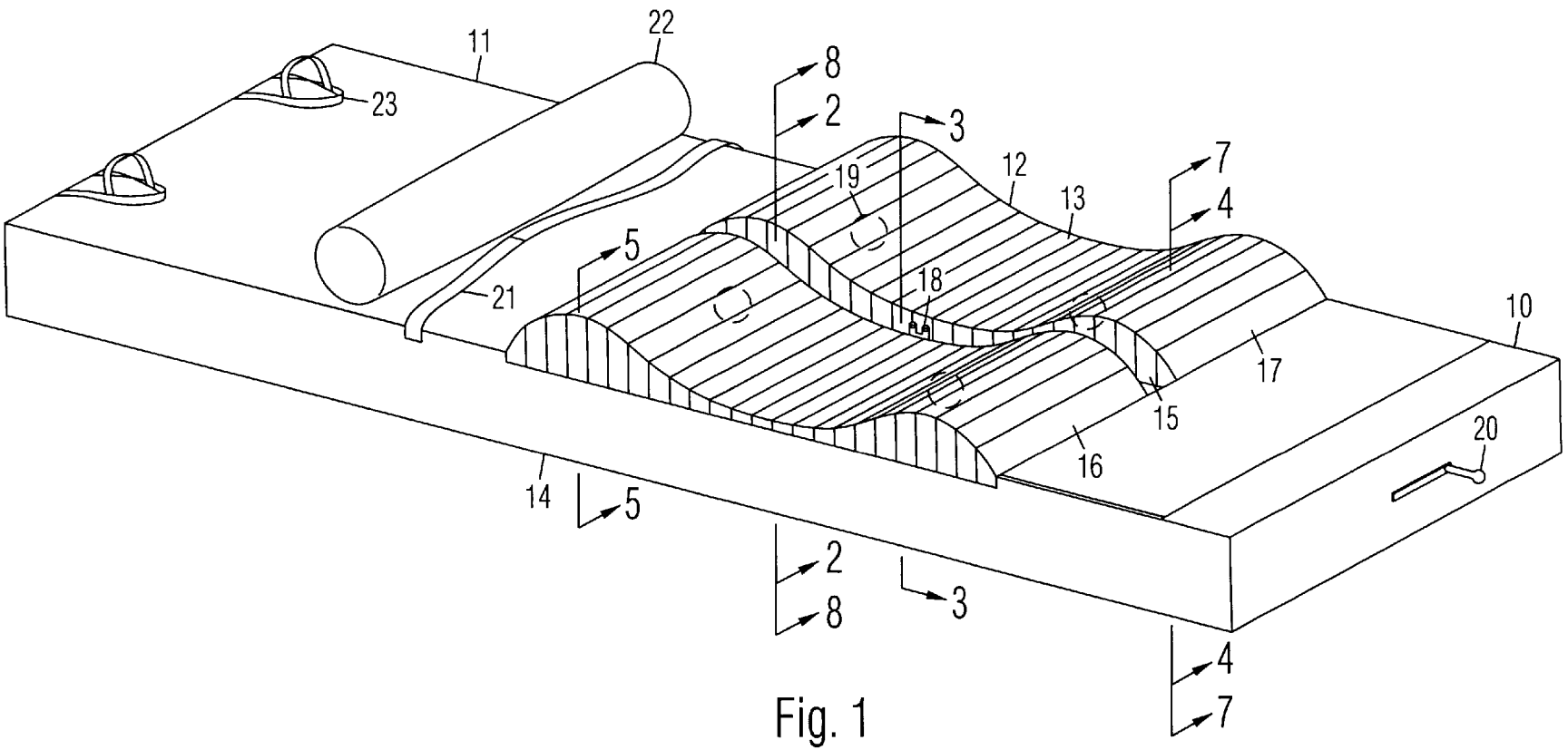
FIG. 1 is a side perspective view of the present spinal treatment table.

| DRAWING REFERENCE NUMERALS |
|---|
| 10. Head Support |
| 11. Leg Support |
| 12. Spinal Support |
| 13. Support Segments |
| 14. Frame |
| 15. Slot |
| 16. Left Portion |
| 17. Right Portion |
| 18. Spinal Manipulation Device |
| 19. Back Manipulation Devices |
| 20. Adjustment Control |
| 21. Waist Strap |
| 22. Leg Support |
| 23. Ankle Restraints |
| 24. Resilient Top |
| 25. Rigid Base |
| 26. Linear Drive |
| 27. Screw |
| 28. Screw Gear |
| 29. Belt |
| 30. Elastic Cover |
| 31. Rail |
| 32. Wheels |
| 33. Reciprocating Tip |
| 34. First End Segment |
| 35. Second End Segment |
| 36. Scissors Hinge |
| 37. Belt |
| 38. Drive Gear |
| 39. Rail Segments |
| 40. Spinal Manipulation Device |
| 41. Roller Device |

-continued

| DRAWING REFERENCE NUMERALS |
|---|
| 42. Linear Drive |
| 43. Roller Assembly |
| 44. Rollers |
| 45. Arm |
| 46. Flexible Waterproof Cover |
| 47. Spinal Manipulation Device |
| 48. Water Jet Nozzle |
| 49. Frame |
| 50. Enclosure |
| 51. Linear Drive |
| 52. Supply Hose |
| 53. Pump |

DETAILED DESCRIPTION OF THE INVENTION

FIG. 1:

A first embodiment of the present spinal treatment table is shown in a side perspective view in FIG. 1. It is comprised of a plurality of a head support 10, a leg support 11, and a contoured spinal support 12 there between defined by separate support segments 13 of different heights. There are preferably twenty-four segments, although more or fewer may be provided. Segments 13 are supported longitudinally within a frame 14. A longitudinal slot 15 is arranged along spinal support 12, and divides segments 13 into left portions 16 and right portions 17. A spinal manipulation device 18 is movably positioned within slot 15 for applying therapy along the length of the spinal column of a patient lying face up or supine. Back manipulation devices 19 are positioned inside left and right portions of spinal support 12 for applying therapy to the patient's back, preferably to the scapulas and sacroiliac joints.

Spinal manipulation device 18 is preferably comprised of a thrusting adjuster similar to the type sold under the trademark "ARTHROSTIM" by IMPAC Inc. of Salem, Oreg. Back manipulation devices 19 are preferably comprised of percussion/vibration devices similar to the type sold under the trademark "VIBRACUSSOR" by IMPAC Inc. Spinal support 12 is adjustable in length between its opposite ends. The controls for the spinal manipulation device and back manipulation device may be located anywhere on the table and connected to the devices by wires. A length adjustment control 20 is connected to spinal support 12. In this example, adjustment control 20 is comprised of a hand crank attached to one end of the table. A waist restraint 21, leg support cushion 22, and ankle restraints 23 are attached to leg support 11 for performing lumbar traction.

Figure 2:
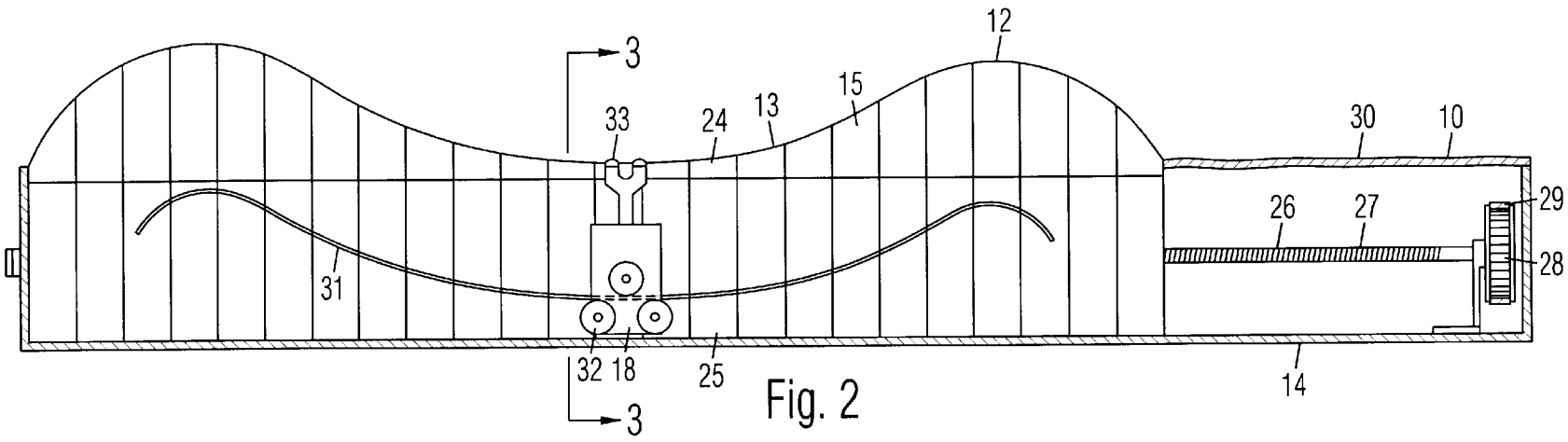
FIG. 2 is a side sectional view thereof taken along line 2—2 in FIG. 1.
Figure 3:
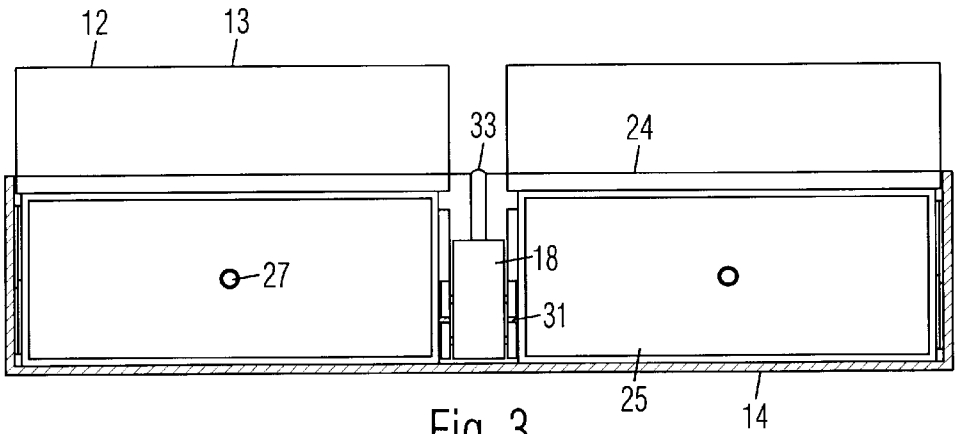
FIG. 3 is an end sectional view thereof taken along line 3—3 in FIG. 1.

FIGS. 2–3:

The table is shown in a side sectional view in FIG. 2 and an end sectional view in FIG. 3 showing slot 15 along spinal support 12. The leg support is not shown. Spinal support segments 13 are movably supported on frame 14. Each segment 13 is comprised of a resilient top 24 on a rigid base 25. The contour of spinal support 12 is preferably provided by having resilient tops of different heights on rigid bases of the same height. Alternatively, resilient tops 24 may be the same height and rigid bases 25 may be of different heights. A linear drive 26 is connected to spinal support 12 for varying its length, and is preferably comprised of a screw drive 27 actuated by a screw gear 28 and a belt 29. Spinal support 12 is shown in a fully contract position at its minimum length. An elastic cover 30 is connected between the end of frame 14 and an adjacent end of spinal support 12.

Spinal manipulation device 18 is positioned in slot 15 and ride along rails 31 attached to the inner sides of left and right portions of spinal support segments 12. Spinal manipulation device 18 is provided with wheels 32 that ride along rails 31. Wheels 32 are preferably driven by a motor within spinal manipulation device 18. Alternatively, spinal manipulation device 18 may be driven along rails 31 by an external mechanism, such as a drive belt. In this embodiment, spinal manipulation device 18 is comprised of an axially reciprocating tip 33 driven by an internal motor for applying linear thrusts to the spinal column. Rails 31 are generally parallel to the surface contour of spinal support 12 to maintain spinal manipulation device 18 at generally the same angle relative to the surface contour along the entire length of spinal support 12. In this example, tip 33 is a forked tip, but it may be of other shapes.

Figure 4:
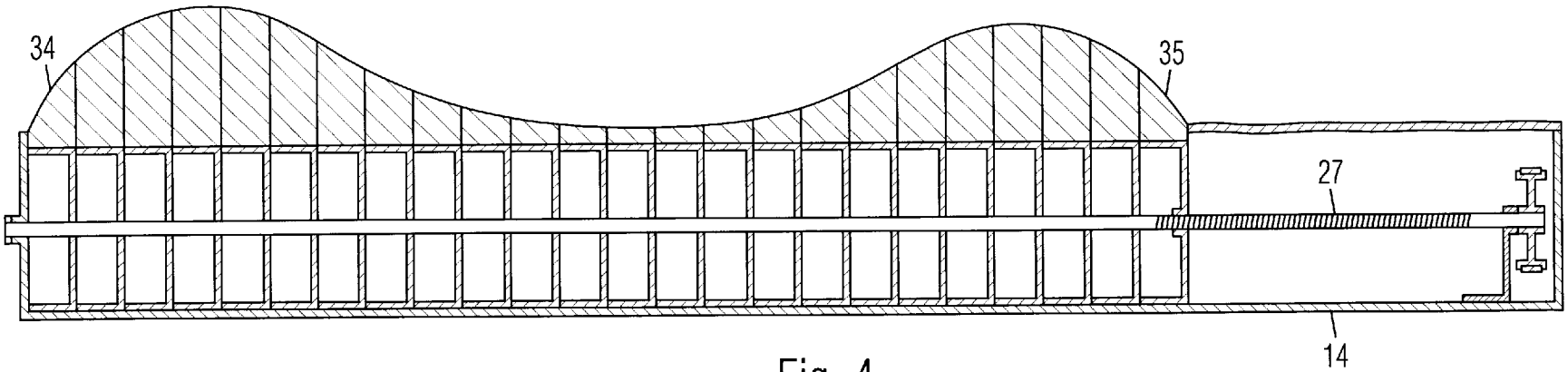
FIG. 4 is a side sectional view thereof taken along line 4—4 in FIG. 1.

FIG. 4:

The table is shown in a side sectional view in FIG. 4. Linear drive 26 is positioned through support segments 13. A first end segment 34 is anchored to frame 14, whereas all the other segments are movable. The anchored segment may be at either the shoulder or waist end of frame 14. Only a second end segment 35 is connected to linear drive 26, for example, by having an internal thread coupled to an external thread on screw 26.

Figure 5:
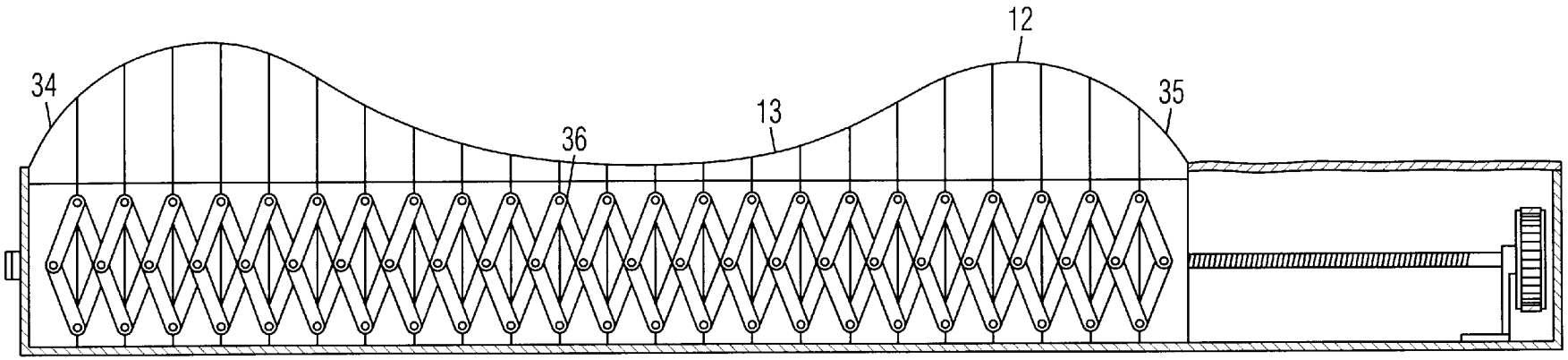
FIG. 5 is a side sectional view thereof taken along line 5—5 in FIG. 1.

FIG. 5:

The table is shown in a side sectional view in FIG. 5. Support segments 13 are connected together by a scissors hinge 36 which terminates at first end segment 34. Alternatively, scissors hinge 36 may be extended by an additional segment and attached to frame 14, and first end segment 34 may also be movable but still anchored to frame 14 by the last segment of scissors hinge 36.

Figure 6:
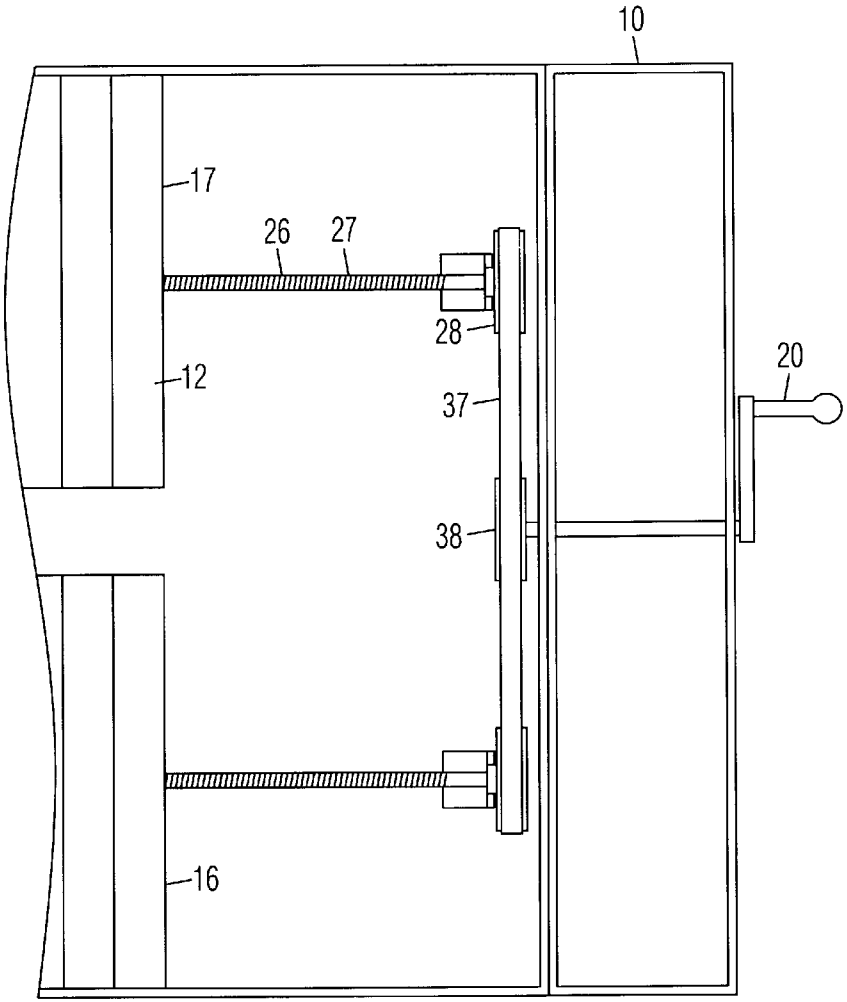
FIG. 6 is a cutaway top view thereof to illustrate an internal linear drive.

FIG. 6:

IF Head support 10 of the table is shown in a top view in FIG. 6 without the elastic cover to reveal linear drive 26 which varies the length of spinal support 12. Linear drive 12 is comprised of screws 27 respectively connected to left and right segments 16 and 17 of spinal support 12. Screw gears 28 are attached to the ends of screw drives 27, and a belt 37 is connected between gears 28. A drive gear 38 is positioned within belt 37, and is driven by adjustment control or hand crank 20. Turning hand crank 20 turns screw drives 26 simultaneously in the same direction for contracting or extending the length of spinal support 12. Alternatively, the movable second ends of the left and right segments of spinal support 12 may be connected by a cross bar, and moved simultaneously by a single screw. Also, another type of linear drive may be provided, such as a motor drive, in which case adjustment control 20 may be comprised of electrical controls.

Figure 7:
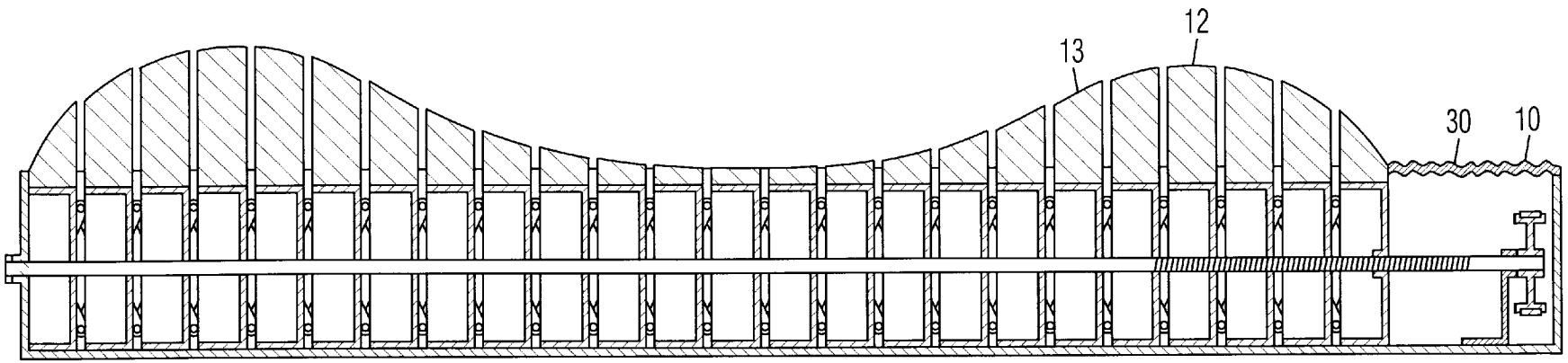
FIG. 7 is a side sectional view thereof taken along line 7—7 in FIG. 1.

FIG. 7:

The table is shown in a side sectional view in FIG. 7. Spinal support 12 is partially extended. All segments 13 are moved apart from respective adjacent segments by an equal amount to vary the length of spinal support 12 for supporting patients of different heights. Elastic cover 30 at head support 10 is automatically contracted. Spinal support 12 is preferably adjustable from a minimum length of about 24" to a maximum length of about 30" for supporting patients of different heights, although the adjustment range may be greater or smaller.

Figure 8:
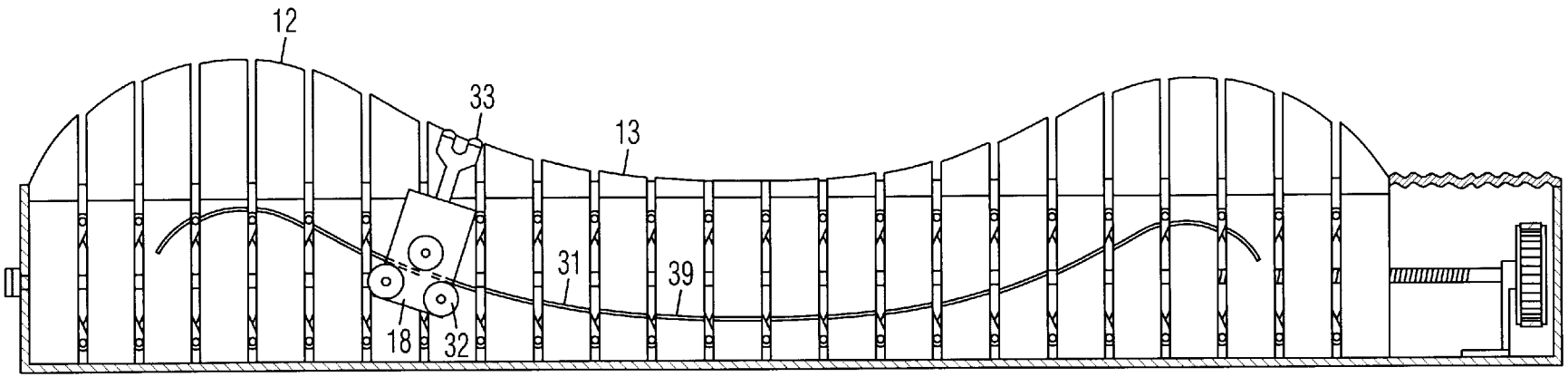
FIG. 8 is a side sectional view thereof taken along line 8—8 in FIG. 1.

FIG. 8:

The table is shown in a side sectional view in FIG. 8 with spinal support 12 partially extended. Each rail 31 is comprised of separate segments 39 attached to respective spinal support segments 13. Rail 31 is divided by numerous discontinuities when spinal support 12 is extended as shown. In this example, spinal support 12 has an extension range of about 6". When spinal support 12 is comprised of twenty-four segments, the largest possible discontinuity is only about 0.25". Since wheels 32 on spinal manipulation device 18 are substantially larger than the largest possible discontinuity, they can easily ride across the discontinuities. Spinal manipulation device 18 is driven along rail 31 to apply therapy to different parts of the patient's spinal column. Rod 33 on spinal manipulation device 18 is maintained by rail 31 at the same angle relative to the surface contour of spinal support 12 for evenly applying therapy along the entire length of the patient's spinal column.

Figure 9:
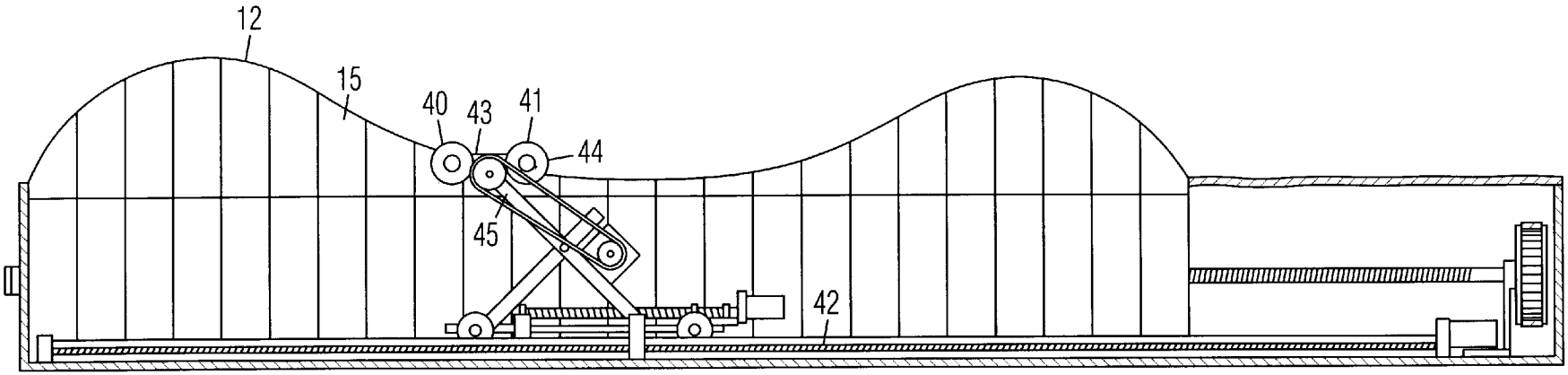
FIG. 9 is a side sectional view of a second embodiment thereof.

FIG. 9:

A second embodiment of the table is shown in a side sectional view in FIG. 9. It is comprised of adjustable spinal support 12, and a spinal manipulation device 40 comprised of a motorized roller device 41 which is driven longitudinally along slot 15 in spinal support 12 by a linear drive 42, such as a screw drive. Roller device 41 includes a roller assembly 43 with a plurality of rollers 44, wherein roller assembly 43 is pivoted at the end of an upwardly biased pivotable arm 45. Roller assembly 43 is arranged to pivot about the end of arm 45 to follow the contour of the patient's back. Arm 45 is also arranged to pivot up and down to keep roller assembly 43 pressed against the patient's back at all linear positions.

Figure 10:
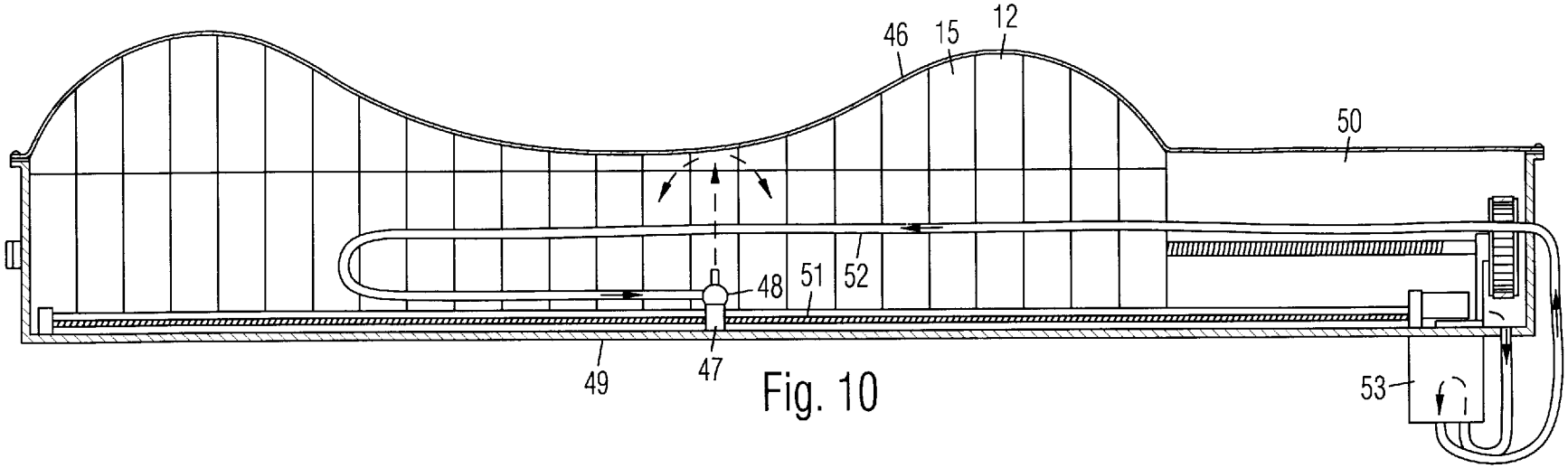
FIG. 10 is a side sectional view of a third embodiment thereof.

FIG. 10:

A third embodiment of the table is shown in a side sectional view in FIG. 10. It is comprised of an adjustable spinal support 12, a flexible waterproof cover 46 on top of spinal support 12, and a spinal manipulation device 47 comprised of a water jet nozzle 48. Any number of nozzles may be provided. Cover 46 is sealed against a rim of a frame 49 with a gasket to define a watertight enclosure 50. Nozzle 48 is driven longitudinally along slot 15 in spinal support 12 by a linear drive 51, such as a screw drive. Slot 15 is spanned by cover 46 to prevent water from escaping. Nozzle 48 is supplied by a supply hose 52 connected to a pump 53 which draws and recycles water from the bottom of enclosure 50. Only a shallow pool of water is necessary inside enclosure 50. High velocity water is directed at the bottom of flexible cover 46 over slot 15 to apply therapy to the patient's spinal column. Nozzle 48 is movable to different linear positions for applying therapy along the entire length of the patient's spine. Water falling back to the bottom of enclosure 50 is drawn back into pump 53 and recycled.

Figure 11:
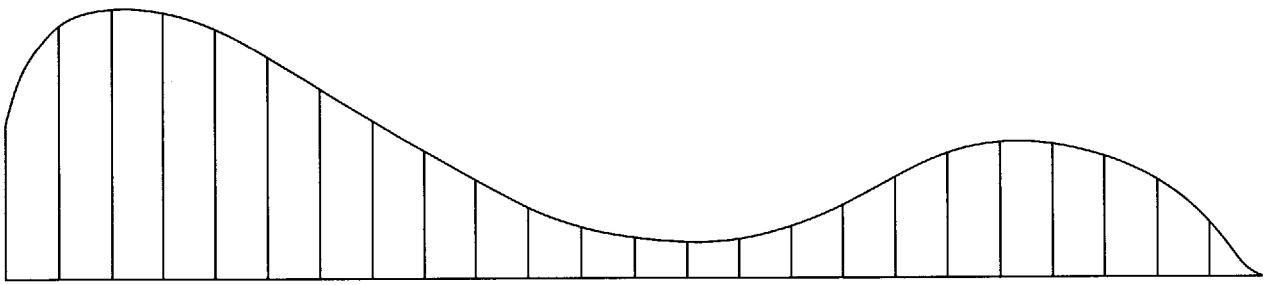
FIG. 11 is a side view of a preferred contour of the spinal support thereof.

FIG. 11:

A preferred contour of spinal support 12 is shown in FIG. 11. The example shown is fully compacted to about 24". The right side is the shoulder end for supporting the upper back, and the left side is the lumber end for supporting the lower back.

SUMMARY AND SCOPE

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. In additional to chiropractic therapy, the table can be used for massage and other types of therapies. Therefore, the scope of the invention should be determined by the appended claims and their legal equivalents, not by the examples given.

I claim:

1. A spinal treatment table, comprising:

a contoured spinal support for evenly supporting a spine of a patient lying face up, wherein said spinal support is comprised of separate support segments of different heights connected by a scissors hinge in a longitudinal series and cooperating to define a predetermined surface contour, said spinal support is stretchable longitudinally wherein said support segments are caused by said scissors hinge to simultaneously move apart from each other by equal distances and evenly vary said contour in length for supporting different patients of different heights.

2. The spinal treatment table of claim 1, further including a frame supporting said spinal support, a screw drive extending through an internally threaded hole in a second end segment of said spinal support for varying the length of said contour, wherein a first end segment of said spinal support is anchored to said frame, and all other segments of said spinal support are movable along said frame.

3. The spinal treatment table of claim 1, further including a frame supporting said spinal support, a head support attached to a shoulder end of said frame, a leg support connected to a lumbar end of said spinal support, a waist restraint attached to said leg support, a leg support cushion attached to said leg support, and ankle restraints attached to said leg support for applying lumbar traction to said patient.

4. The spinal treatment table of claim 1, wherein said contour of said spinal support is adjustable from a minimum length of about 24" to a maximum length of about 30" for supporting different patients.

5. The spinal treatment table of claim 1, further including a plurality of vibration devices positioned inside said spinal support for applying therapy to a back of said patient.

6. A spinal treatment table, comprising:

a contoured spinal support for evenly supporting a spine of a patient lying face up, wherein said spinal support is comprised of separate support segments of different heights arranged in a longitudinal series and cooperating to define a predetermined surface contour, said support segments are movable apart longitudinally from each other to enable said contour to be adjustable in length for supporting different patients of different heights;

a longitudinal slot arranged along said spinal support and dividing said support segments into left portions and right portions; and a spinal manipulation device movably positioned within said slot for applying therapy along said spine of said patient.

7. The spinal treatment table of claim 6, further including a scissors hinge connecting said spinal support segments and enabling each of said spinal support segments to be moved apart from adjacent segments by an equal amount to evenly vary said contour in length.

8. The spinal treatment table of claim 6, further including a frame supporting said spinal support, a screw drive extending through an internally threaded hole in a second end segment of said spinal support for varying the length of said contour, wherein a first end segment of said spinal support is anchored to said frame, and all other segments of said spinal support are movable along said frame.

9. The spinal treatment table of claim 6, further including rails attached to respective inner sides of said left portions and said right portions of said support segments, and wheels attached to said spinal manipulation device and riding along said rails, wherein said rails are generally parallel to said contour of said spinal support to maintain said spinal manipulation device at a generally constant angle relative to said contour along the length of said contour.

10. The spinal treatment table of claim 6, wherein said spinal manipulation device is comprised of a linear thrusting adjuster with an axially reciprocating rod.

11. The spinal treatment table of claim 6, wherein said spinal manipulation device is comprised of a motorized roller device including a roller assembly with a plurality of rollers, wherein roller assembly is pivoted at an end of an upwardly biased pivotable arm, a lower end of said arm is hinged to a linear drive for movement along said slot, said arm is pivotable to keep said roller assembly pressed against said spine of said patient along the length of said contour.

12. The spinal treatment table of claim 6, wherein said spinal manipulation device is comprised of a water jet nozzle, and further including a frame positioned around said spinal support, a flexible waterproof cover on top of said spinal support sealed against a rim of said frame to define a watertight enclosure, a pump connected between said nozzle and a bottom of said enclosure for pumping water from bottom of said enclosure to said nozzle, wherein said nozzle is arranged for directing a jet of water at a bottom of said flexible cover along said slot to apply therapy to said spine of said patient.

13. The spinal treatment table of claim 6, wherein said contour of said spinal support is adjustable from a minimum length of about 24" to a maximum length of about 30" for supporting different patients.

14. The spinal treatment table of claim 6, further including a plurality of vibration devices positioned inside said spinal support for applying therapy to a back of said patient.

15. The spinal treatment table of claim 6, further including a leg support connected to a lumbar end of said spinal support, a waist restraint attached to said leg support, a leg support cushion attached to said leg support, and ankle restraints attached to said leg support for applying lumbar traction to said patient.

16. The spinal treatment table of claim 6, further including a frame supporting said spinal support, an elastic cover connected between a shoulder end of said frame and an adjacent end of said spinal support, wherein said elastic cover is arranged to automatically expand and contract respectively in response to contraction and expansion of said spinal support.

17. The spinal treatment table of claim 6, further including rails attached to respective inner sides of said left portions and said right portions of said support segments, and wheels attached to said spinal manipulation device and riding alone said rails, wherein said tracks rails are generally parallel to said contour of said spinal support to maintain said spinal manipulation device at a generally constant angle relative to said contour along the length of said contour, each of said rails is comprised of separate segments attached to respective support segments, each of said rails is divided by discontinuities when said spinal support is extended, and said wheels on said spinal manipulation device are larger than a largest possible discontinuity for riding across said discontinuities.

18. A spinal treatment table, comprising:

a frame;

a contoured spinal support arranged in said frame for evenly supporting a spine of a patient lying face up, wherein said spinal support is comprised of separate support segments of different heights arranged in a longitudinal series and cooperating to define a predetermined surface contour, said support segments are movable apart longitudinally from each other to enable said contour to be adjustable in length for supporting different patients of different heights;

a scissors hinge connecting said spinal support segments and enabling all of said spinal support segments to be moved apart from adjacent segments by an equal amount to evenly vary the length of said spinal support for supporting patients of different heights;

a linear drive connected to said spinal support for varying the length thereof, wherein a first end segment of said spinal support is anchored to said frame, and all other segments of said spinal support are movable, said linear drive comprises a screw drive connected to an internally threaded hole in a second end segment of said spinal support;

a longitudinal slot arranged along said spinal support dividing said support segments into left portions and right portions;

a spinal manipulation device movably positioned within said slot for applying therapy along the length of said spine of said patient; and rails attached to respective inner sides of said left portions and said right portions of said support segments, wherein said spinal manipulation device is provided with wheels that ride along said rails, said rails are generally parallel to a surface contour of said spinal support to maintain said spinal manipulation device at a generally constant angle relative to said surface contour along the entire length of said spinal support.

19. The spinal treatment table of claim 18, wherein said spinal manipulation device is comprised of a linear thrusting adjuster with an axially reciprocating rod.

20. The spinal treatment table of claim 18, wherein said spinal manipulation device is comprised of a motorized roller device including a roller assembly with a plurality of rollers, wherein roller assembly is pivoted at an end of an upwardly biased pivotable arm, a lower end of said arm is hinged to a linear drive for movement along said slot, said arm is pivotable to keep said roller assembly pressed against said spine of said patient along the length of said contour.

21. The spinal treatment table of claim 18, wherein said contour of said spinal support is adjustable from a minimum length of about 24" to a maximum length of about 30" for supporting different patients.

22. The spinal treatment table of claim 18, further including a plurality of vibration devices positioned inside said spinal support for applying therapy to a back of said patient.

23. The spinal treatment table of claim 18, further including a leg support connected to a lumbar end of said spinal support, a waist restraint attached to said leg support, a leg support cushion attached to said leg support, and ankle restraints attached to said leg support for applying lumbar traction to said patient.

24. The spinal treatment table of claim 18, further including an elastic cover connected between a shoulder end of said frame and an adjacent end of said spinal support, wherein said elastic cover is arranged to automatically expand and contract respectively in response to contraction and expansion of said spinal support.

* * * * *